US006780798B2

(12) United States Patent
Kassner et al.

(10) Patent No.: US 6,780,798 B2
(45) Date of Patent: Aug. 24, 2004

(54) TEXTILE LATTICE FOR REINFORCING BITUMEN-BONDED LAYERS

(75) Inventors: Jürgen Kassner, Gescher (DE); Heiko Pintz, Nordhorn (DE); Ulrich Von Fransecky, Bocholt (DE)

(73) Assignee: Huesker Synthetic GmbH & Co., Gescher (DE)

( * ) Notice: Subject to any disclaimer, the term of this patent is extended or adjusted under 35 U.S.C. 154(b) by 78 days.

(21) Appl. No.: 10/245,536

(22) Filed: Sep. 17, 2002

(65) Prior Publication Data

US 2003/0017771 A1 Jan. 23, 2003

Related U.S. Application Data

(63) Continuation of application No. 09/331,282, filed on Oct. 4, 1999, now Pat. No. 6,503,853.

(30) Foreign Application Priority Data

Dec. 17, 1996 (DE) ..... 196 52 584
Dec. 5, 1997 (EP) ..... EP97/6809

(51) Int. Cl.[7] ..... B32B 5/26; B32B 3/10

(52) U.S. Cl. ..... 442/57; 442/1; 442/50; 442/54; 442/58; 428/102; 428/131

(58) Field of Search ..... 442/1, 50, 54, 442/57, 58; 428/102, 131

(56) References Cited

U.S. PATENT DOCUMENTS

| | | | | |
|---|---|---|---|---|
| 4,211,807 A | * | 7/1980 | Yazawa et al. | 428/109 |
| 4,737,393 A | | 4/1988 | Linkous | |
| 6,235,657 B1 | | 5/2001 | Schops et al. | |
| 6,503,853 B1 | * | 1/2003 | Kassner et al. | 442/57 |

FOREIGN PATENT DOCUMENTS

| | | |
|---|---|---|
| DE | 7320271 | 11/1973 |
| DE | 3818492 A1 | 5/1988 |
| DE | 3821785 A1 | 1/1990 |
| DE | 9207367 | 5/1992 |
| DE | 1962584.5 | 6/1998 |
| EP | 0 368 600 B1 | 11/1989 |

OTHER PUBLICATIONS

"*Hochzugfeste Geotextilien fur bewehrte Erdkorper" (geotextiles with high tensile strength for reinforced earth bodies)*, Tis Tiefbau, Ingenieurbau, Strassenbau; Mar. 1996.

Fachinformationen fur Planer, Behorden, Bauleiter und Baumeitster;"*Bestens bewehrt mit Arter und Macrit"*; News Direkt; Germany; pp. D22–D23 (Mar. 1996).

(List continued on next page.)

*Primary Examiner*—Elizabeth M. Cole
*Assistant Examiner*—Norca L. Torres
(74) *Attorney, Agent, or Firm*—Choate, Hall & Stewart

(57) ABSTRACT

The invention relates to a wide-meshed, textile lattice to provide reinforcement for bitumen-bonded layers, in particular of road surfacing, which is coated with a bonding compound having an affinity for bitumen and essentially consisting of two sets of parallel, load-bearing threads (1, 2), whereby one set of threads (1) extends in the longitudinal direction of the lattice and the other set of threads extends in the direction perpendicular to the longitudinal direction of the lattice and the threads (1, 2) are of glass fibres or chemical fibres such as polymer fibres or polycondensate fibres.

In order to develop a reinforcing lattice for bitumen-bonded layers which provides a better bond with a pre-prepared formation than the known lattices, the over-crossed threads (1, 2) are secured to a thin fleece (3) by Raschel-locking, whereby the binding Raschel-locking threads (5) surround the longitudinally extending threads (1) of the lattice and secure the threads (2) extending transversely.

33 Claims, 2 Drawing Sheets

OTHER PUBLICATIONS

"*Bestens bewehrt*"; Straβen–und Tiefbau; (Jan. 1996).
"*Kettenwirk Praxis* 1/89"; (Jan. 1989).
Sounderdruck, Ausgabe; "*High quality composite materials produced on the RS*3 *MSU–V magazine weft raschel machine*"; (Apr. 1987).
Musterteil; ketenwirk praxis 3/96; "*Asphaltwerstarkungs–Verbundstoff=Composite fabric for asphalt reinforcement*"; (Mar. 1996).
Ketenwirk praxis 4/91; p. 69; (Apr. 1991).
Ketenwirk praxis 3–93; p. 46–47, 57; (Mar. 1993).
"*Reduction of pavement cracking*"; TUT ler TRIMESTRE 1995 No. 15 (1995).
John Porter; Canada; Textil '94; "*New Possiblities for Reduction of Cracking of Asphaltic Pavement Overlays of Glassfibre Reinforcement*".
Karl Mayer; "*Kunststoffbewehrte Tragschicht auf weichem Untegrund–eine Vergleichsuntersuchung*"; DIPLOMARBEIT; (Sep. 1992).
"*Dimensionally stable Imultiaxial geogrid*"; kettenwirk Praxis Jan. 1993.

* cited by examiner

TEXTILE LATTICE FOR REINFORCING BITUMEN-BONDED LAYERS

This application is a continuation of U.S. patent application Ser. No. 09/331,282 filed Oct. 4, 1999, now U.S. Pat. No. 6,503,853.

FIELD OF THE INVENTION

The invention relates to a wide-meshed, textile lattice to provide reinforcement for bitumen-bonded layers, in particular for road surfaces.

BACKGROUND OF THE INVENTION

A lattice bonded to a fleece is known from publication EP 0413 295 A. The geo-textile used for reinforcing layers of asphalt known from this publication is a bonding material consisting of two components, one of these components being a fleece and a second of these components being a woven fabric, knitted fabric, thread pattern, lattice or any other flat layout having a defined yarn position. The bonding material is provided as a Raschel-locking material in which the two components are integrated one in the other by means of an end-latching Raschel technique. The fleece is designed to have a good capacity for absorbing bitumen so that when the geo-textile is laid down, this fleece becomes impregnated with bitumen and acts as a barrier to water. The fleece is also intended as a means of preventing the occurrence of tearing and the propagation of tearing in the layers of asphalt. The weight of the fleece by surface area should be 50 to 300$\alpha$/m$^2$, preferably 100 to 180 g/m$^2$. This geo-textile fonus a separating layer in the installed state.

DE 20 00 937 discloses a wide-meshed textile lattice for reinforcing road surfacing, which is pre-fabricated so that it is coated with a specific bonding substance having an affinity to bitumen, e.g. a bitumen-latex emulsion, in order to produce a good adhesion between the lattice and the bitumen bonded layers.

In order to obtain a firm bond between the layers of the road surfacing on the two sides of the reinforcing lattice, there is an advantage to be had if the lattice is made with a wide mesh so that the distance between the parallel threads in the longitudinal direction and those in the transverse direction is 20 to 100 mm. The mesh width should be determined on the basis of the largest grain diameter of the surfacing mixture to be used. Advantageously, the mesh width is 2 to 2.5 times greater than the largest grain diameter. The load-bearing threads in the longitudinal and transverse directions should have a breaking strength of from 10 to 100 kN/m. If necessary or desirable, even stronger threads can be used for the reinforcing lattice.

As a result of the coating of bonding substance, the lattice is of a semi-rigid consistency. The lattice, which is 5 m wide and 30 or 50 m long, for example, is rolled out onto a surface which has been evenly sprayed with a bonding compound or bitumen emulsion. The reinforcing lattice should be laid out flat and free of folds before any further surfacing mixture is applied to the reinforcing lattice. In the case of these known lattices, a difficulty arises in that once rolled out, the reinforcing lattice slides causing creases, particularly when vehicles are driven over the laid-out lattice.

It is therefore desirable to develop a reinforcing lattice for bitumen-bonded layers which does not act as a separating layer between these layers and which provides better bonding that the known lattices on a pre-prepared road level.

SUMMARY OF THE INVENTION

According to one aspect of the invention, the fleece has a weight of 10 to 50 g/m$^2$ and the load bearing threads are treated and coated together with the fleece, with a bonding substance having an affinity to bitumen, the fleece having openings in the coating of bonding substance and being perforated in order to be permeable to air.

Due to the fact that the mesh of the lattice is filled with a thin fleece, a significantly stronger bond is produced when the lattice is laid on the formation. On the other hand, the fleece is so thin and consequently so flexible that the fleece does not act as a separating layer between the asphalt layers underneath and above the lattice. In spite of the existence of the fleece, nevertheless a firm keying action between the coarse grains of the surfacing mixture laid on top of the lattice and the coarse grains of the surfacing mixture underneath the lattice is achieved.

Due to the fact that the load-bearing threads of the lattice in the direction of the warp are lashed by the Raschel locking threads, the load-bearing threads running at right-angles thereto are fixed at their respective distances from one another.

In accordance with another aspect of the invention, there is no need for the lattice to be impregnated or coated with a bonding compound having an affinity for bitumen if the load-bearing threads are made from a polymer or a polycondensate, which in itself provides a firm bond with bitumen.

Furthermore, the underside of the composite of the textile lattice and the thin fleece may be provided with a bituminous mastic. This bituminous mastic melts when the hot asphalt mixture needed to form the bituminous surfacing is deposited on the laid lattice matting. It is advantageous to apply the bituminous mastic only in spots or stripes parallel with the winding axis in order to preserve the flexibility of the reinforcing lattice. The quantity of the bitumen-latex emulsion to be sprayed on the road level is considerably reduced by the bituminous mastic on the composite and may even be omitted completely. The installation of the lattice is simplified and the time for installing the reinforcement is reduced. The quantity of the mastic to be applied depends on the condition of the asphalt or road surfacing to be renewed. It ranges preferably from 150 g to 500 g/m$^2$.

In accordance with another aspect of the invention, a wide-meshed textile lattice to provide reinforcement for bitumen-bonded layers includes two sets of parallel, load-bearing threads, whereby one set of threads extends in the longitudinal direction of the lattice and the other set of threads extends transversely to the longitudinal direction of the lattice and the threads are made from glass fibers or chemical fibers such as polymer fibers or polycondensate fibers and are Raschel-locked onto a fleece, whereby the connecting Raschel-locking threads surround the longitudinally extending threads of the lattice and secure the transversely extending threads. The lattice may be woven or Raschel-locked but alternatively the load-bearing parallel threads running transversely to the longitudinal direction may be laid on the load-bearing parallel threads and bonded to the longitudinal threads at the intersecting point by bonding and welding.

BRIEF DESCRIPTION OF THE DRAWINGS

Features and advantages of the present invention will become more apparent from the following detailed description of exemplary embodiments thereof taken in conjunction with the accompanying drawings in which.

DESCRITPION OF PREFERRED EMBODIMENT (S)

Figure 1:
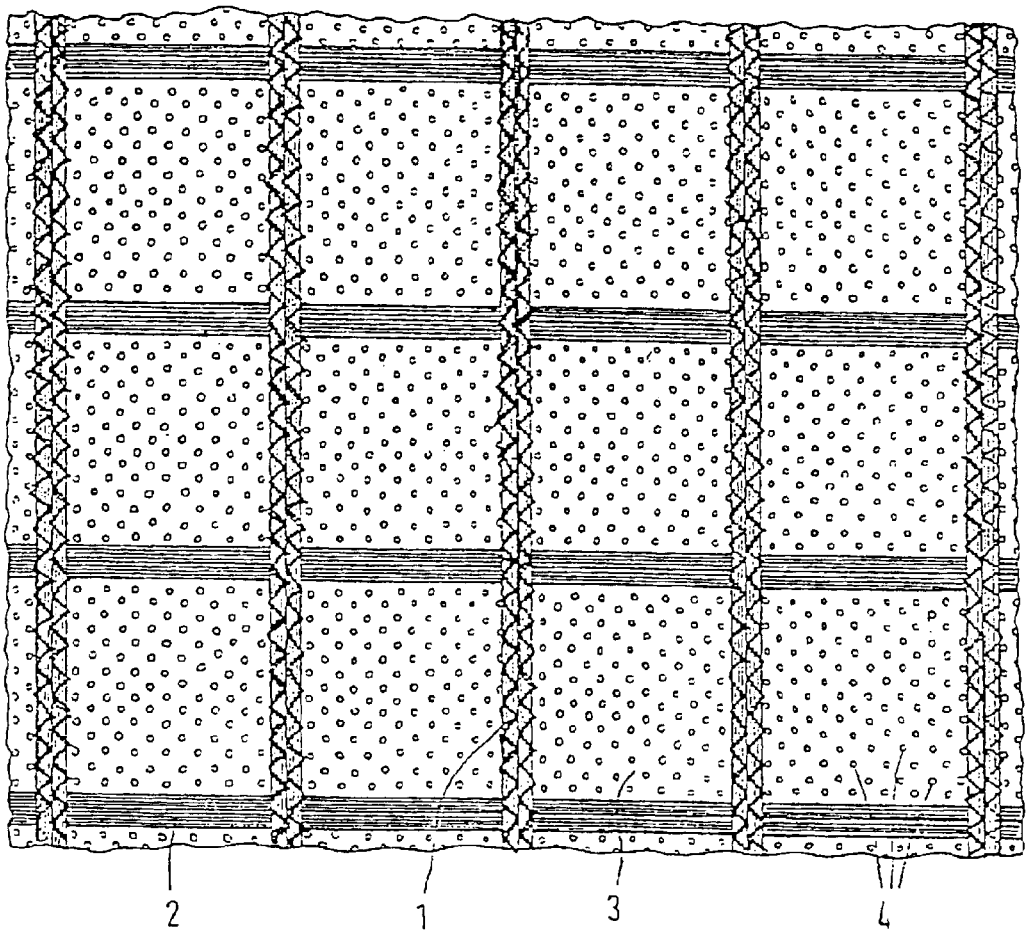
FIG. 1 is a plan view of a reinforcing lattice of the invention.
Figure 2:
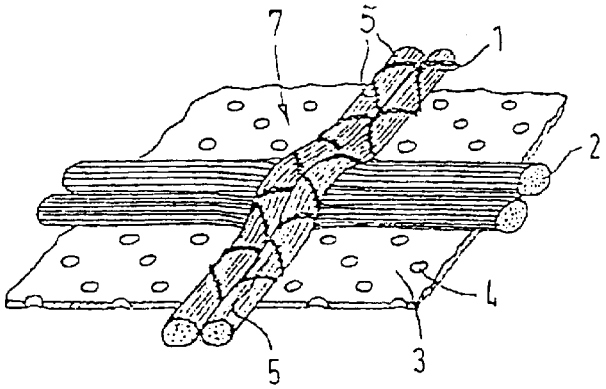
FIG. 2 is a detail of a cross-over point of the reinforcing lattice.
Figure 3:
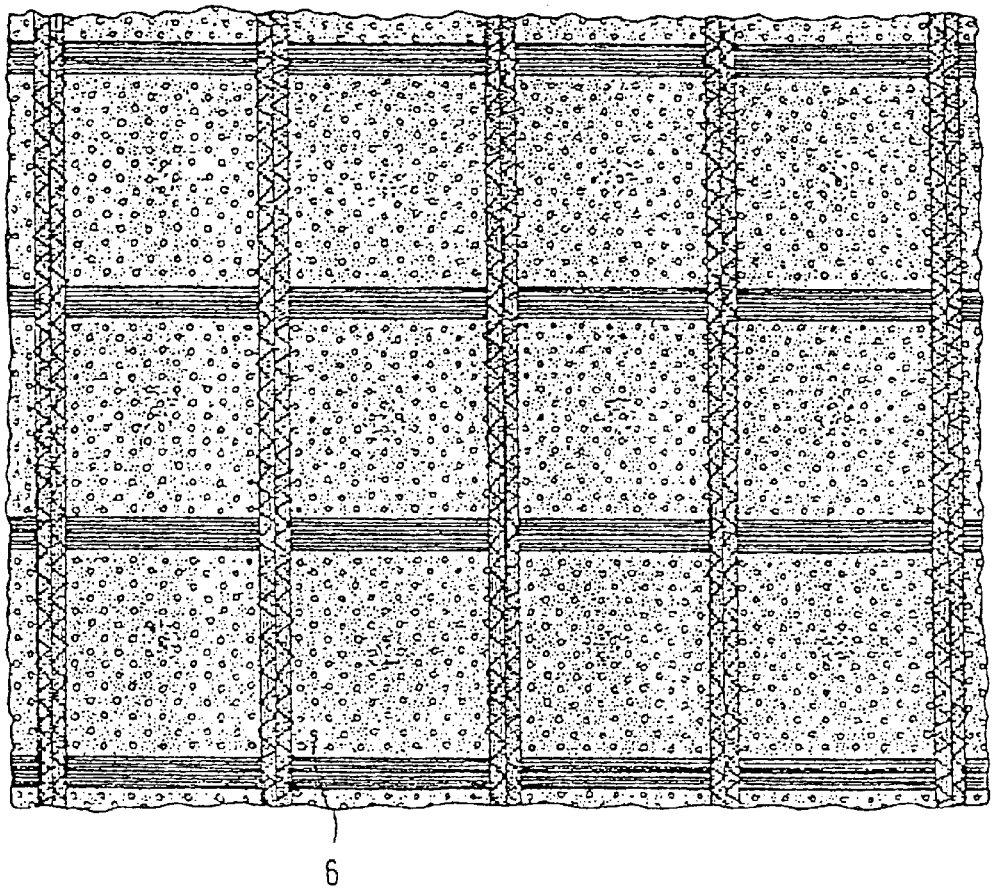
FIG. 3 shows a reinforcing lattice such as that of FIG. 1 coated with a bonding compound.

The textile lattice for providing reinforcement for bitumen-bonded layers illustrated in FIGS. 1 to 3 essentially consists of two sets of parallel load-bearing threads 1 and 2. The threads 1 of the lattice run in the direction of the warp or longitudinal direction of the lattice whilst the threads 2 run transversely thereto. The load-bearing threads are made from highly modular polymer fibers or polycondensate fibers, for example fibers made of aramide or polyvinyl alcohol, in particular in the form of endless fibers. However, the load-bearing fibers may also be glass fibers. The threads 1 extending longitudinally, each made up of two bundles of fibers in the embodiment illustrated, are surrounded by Raschel locking threads 5, which join the longitudinally extending threads 1 as well as the transversely extending threads 2 to a thin fleece 3. As can be seen with particular clarity from FIG. 2, the threads 2 extending transversely are arranged between the fleece 3 and the threads 1 which extend longitudinally. This layout is more stable than an arrangement whereby the threads 2 extending transversely run across the longitudinally extending threads 1. The load-bearing threads 1 and 2 may be impregnated or coated with a bonding compound even before they are secured to the fleece 3 by Raschel-locking. For practical purposes, however, the load-bearing threads 1 and 2 are coated with the bonding compound 6 on the fleece 3. In order to keep the consumption of bonding compound, in particular a bitumen-latex emulsion, within limits, the layer applied is so thin that the fleece 3 is still permeable to air.

As can be seen particularly clearly from FIGS. 1 and 2, the fleece 3 is perforated. Holes 4 of a 0.5 to 4 mm diameter are punched through the fleece in a regularly distributed pattern. The proportion of holes in relation to the total surface area of the fleece is at least 10%.

The fleece 3, which is made from PETP, PET or PP fibers, threads or filaments and hardened by heat, chemical or mechanical processing, weighs from 10 to 50 g/m$^2$.

The Raschel threads 5 used to secure the lattice are perfectly adequate as a rule. In specific circumstances, however, the load-bearing threads may also be additionally bonded to one another by bonding or welding at their cross-over points.

In order to produce a firm bond for the layers of an asphalt surfacing, it is an advantage if the load-bearing threads 1 and 2 are not flat but rounded and of a diameter of from 2 to 4 mm.

A bituminous mastic melting at 60° C. is applied to the lower surface of the reinforcing lattice in form of spots (not shown) or stripes parallel to the rolling axis in order to preserve the flexibility of the composite comprising the lattice 1, 2, the fleece 3, the coating 6 having an affinity for bitumen and meltable bituminous mastic is preserved.

What is claimed is:

1. A wide-meshed, textile lattice to provide reinforcement for bitumen-bonded layers comprising: two sets of parallel, load-bearing threads, wherein a first set of threads extends in the longitudinal direction of the lattice and the other set of threads extends transversely to the longitudinal direction of the lattice, wherein the threads are made of one of: glass fibers and synthetic fibers and the meshes of the lattice are filled with a thin fleece which is processed, said lattice and said thin fleece being coated with a bonding compound that enhances bonding to bitumen such that the thin fleece has orifices in the coating of bonding compound in order to be permeable to air.

2. The wide-meshed, textile lattice of claim 1, wherein the threads are secured to the thin fleece by Rasehel-locking threads and the Rasehel-locking threads surround the longitudinally extending threads of the lattice and secure the threads extending transversely.

3. The wide-meshed, textile lattice of claim 1, wherein the thin fleece has a weight in the range of 10 to 100 g/m$^2$.

4. The wide-meshed, textile lattice of claim 3, wherein the thin fleece has a weight of less than 50 g/m$^3$.

5. The wide-meshed, textile lattice of claim 2, wherein the transversely extending threads are arranged between the thin fleece and the longitudinally extending threads.

6. The wide-meshed, textile lattice of claim 1, wherein the thin fleece is made from a material selected from the group consisting of: polyethylene terephthalate (PETP), polyethylene (PET) and polypropylene (PP), and is in a form selected from the group consisting of: fibers, threads and filaments hardened by one of: heat, chemical and mechanical processing.

7. The wide-meshed, textile lattice of claim 1, wherein the thin fleece is perforated.

8. The wide-meshed, textile lattice of claim 6, wherein holes of a diameter from 0.5 to 4 mm are punched in the thin fleece in a regularly distributed pattern and a proportion of holes in relation to a total surface area of the thin fleece is at least 10%.

9. The wide-meshed, textile lattice of claim 1, wherein the load-bearing threads are joined to one another at cross-over points by one of: bonding and welding.

10. The wide-meshed, textile lattice of claim 1, wherein the load-bearing threads are in a form selected from the group consisting of: rounded 2 to 4 mm diameter strands and double strands which are secured to the thin fleece by Raschel-locking.

11. The wide-meshed, textile lattice of claim 1, wherein a bituminous mastic is provided on an underside of the lattice and said thin fleece.

12. The wide-meshed, textile lattice of claim 11, wherein the bituminous mastic is activated by heating.

13. The wide-meshed, textile lattice of claim 11, wherein the bituminous mastic is deposited in a form selected from the group of: spots, stripes extending transversely, and stripes extending perpendicularly to the longitudinal direction of the lattice.

14. The wide-meshed, textile lattice of claim 1, wherein said threads are made of a material selected from the group consisting of: polymer fibers and polycondensate fibers.

15. A wide-meshed, textile lattice to provide reinforcement for bitumen-bonded layers, comprising: two sets of parallel, load-bearing threads, wherein a first set of threads extends in the longitudinal direction of the lattice and the other set of threads extends transversely to the longitudinal direction of the lattice, wherein the threads are made of one of: glass fibers and synthetic fibers, wherein the lattice is coated with a bonding compound that enhances bonding to bitumen, and wherein the mesh of the lattice is filled with a thin fleece which is so thin and flexible that the fleece does not act as a separating layer between asphalt layers underneath and above the lattice, and whereby said thin fleece permits a firm keying action between coarse grains of an asphalt mixture laid on top of the lattice and coarse grains of an asphalt mixture underneath the lattice.

16. The lattice of claim 15, wherein said bonding compound is made of a bitumen bonding substance.

17. The lattice of claim 15, wherein the transversely extending threads are arranged between the fleece and the longitudinally extending threads.

18. The lattice of claim 15, wherein the load-bearing threads are processed and coated with the bonding compound together with the fleece such that the thin fleece has orifices in the coating of bonding compound in order to be permeable to air.

19. The wide-meshed, textile lattice of claim 15, wherein the threads are secured to the thin fleece by Rasehel-locking threads and the Raschel-locking threads surround the longitudinally extending threads of the lattice and secure the threads extending transversely.

20. The wide-meshed, textile lattice of claim 15, wherein the thin fleece has a weight in the range of 10 to 100 $g/m^2$.

21. The wide-meshed, textile lattice of claim 20, wherein the thin fleece has a weight of less than 50 $g/m^2$.

22. The wide-meshed, textile lattice of claim 15, wherein the transversely extending threads are arranged between the thin fleece and the longitudinally extending threads.

23. The wide-meshed, textile lattice of claim 15, wherein the thin fleece is made from a material selected from the group consisting of: polyethylene terephthalate (PETP), polyethylene (PET) and polypropylene (PP), and is in a form selected from the group consisting of: fibers, threads and filaments hardened by one of: heat, chemical and mechanical processing.

24. The wide-meshed, textile lattice of claim 15, wherein the thin fleece is perforated.

25. Y The wide-meshed, textile lattice of claim 24, wherein holes of a diameter from 0.5 to 4 mm are punched in the thin fleece in a regularly distributed pattern and a proportion of holes in relation to a total surface area of the thin fleece is at least 10%.

26. The wide-meshed, textile lattice of claim 15, wherein the load-bearing threads are joined to one another at crossover points by one of: bonding and welding.

27. The wide-meshed, textile lattice of claim 15, wherein the load-bearing threads are in a form selected from the group consisting of: rounded 2 to 4 mm diameter strands and double strands which are secured to the thin fleece by Rasehel-locking.

28. The wide-meshed, textile lattice of claim 15, wherein a bituminous mastic is provided on an underside of the lattice and said thin fleece.

29. The wide-meshed, textile lattice of claim 28, wherein the bituminous mastic is activated by heating.

30. The wide-meshed, textile lattice of claim 28, wherein the bituminous mastic is deposited in a form selected from the group of: spots, stripes extending transversely, and stripes extending perpendicularly to the longitudinal direction of the lattice.

31. The wide-meshed, textile lattice of claim 15, wherein said threads are made of a material selected from the group consisting of: polymer fibers and polycondensate fibers.

32. A wide-meshed, textile lattice to provide reinforcement for bitumen-bonded layers, comprising: two sets of parallel, load-bearing threads, wherein a first set of threads extends in the longitudinal direction of the lattice and the other set of threads extends transversely to the longitudinal direction of the lattice, wherein the threads are made of a material with an affinity for bitumen, and wherein the mesh of the lattice is filled with a thin fleece which is so thin and flexible that the fleece does not act as a separating layer between asphalt layers underneath and above the lattice, and whereby said thin fleece permits a firm keying action between coarse grains of an asphalt mixture laid on top of the lattice and coarse grains of an asphalt mixture underneath the lattice.

33. The lattice of claim 15, wherein said threads are made of a bitumen bonding substance.

* * * * *